US009663195B2

(12) United States Patent
Van Der Tempel et al.

(10) Patent No.: US 9,663,195 B2
(45) Date of Patent: May 30, 2017

(54) METHOD FOR CONTROLLING A VESSEL MOTION COMPENSATING PLATFORM

(71) Applicant: Ampelmann Operations B.V., Delft (NL)

(72) Inventors: Jan Van Der Tempel, Delft (NL); Frederik Willem Boudewijn Gerner, Amesterdam (NL); David Julio Cerda Salzmann, The Hague (NL); Arie Jan Gobel, Amsterdam (NL)

(73) Assignee: Ampelmann Operations B.V., Delft (NL)

( * ) Notice: Subject to any disclaimer, the term of this patent is extended or adjusted under 35 U.S.C. 154(b) by 0 days.

(21) Appl. No.: 14/945,890

(22) Filed: Nov. 19, 2015

(65) Prior Publication Data

US 2016/0068236 A1 Mar. 10, 2016

Related U.S. Application Data

(62) Division of application No. 13/816,332, filed as application No. PCT/NL2011/050561 on Aug. 12, 2011, now Pat. No. 9,278,736.

(30) Foreign Application Priority Data

Aug. 13, 2010 (NL) ..... 2005231

(51) Int. Cl.
*B63B 27/14* (2006.01)
*B63B 27/30* (2006.01)
(Continued)

(52) U.S. Cl.
CPC ..... *B63B 27/14* (2013.01); *B63B 27/30* (2013.01); *B63J 99/00* (2013.01); *B63B 2017/0072* (2013.01); *B63J 2099/006* (2013.01)

(58) Field of Classification Search
USPC ..... 114/230.12, 230.2, 230.23; 14/71.3, 71.7
(Continued)

(56) References Cited

U.S. PATENT DOCUMENTS 3,577,659 A 5/1971 Kail
4,662,786 A * 5/1987 Cherbonnier ..... B63B 35/44 114/264

(Continued)

FOREIGN PATENT DOCUMENTS

GB 2163402 A 2/1986
NL 1027103 C2 3/2006
WO 2007120039 A1 10/2007

OTHER PUBLICATIONS

International Search Report—PCT/NL2011/050561—Mailing Date: Jan. 12, 2011.

*Primary Examiner* — Gary Hartmann
(74) *Attorney, Agent, or Firm* — Banner & Witcoff, Ltd.

(57) ABSTRACT

A vessel including a motion compensation platform are disclosed. The platform comprises at least one carrier for bearing, moving and/or transferring a load, and a gangway provided with a first end pivotably connected to the carrier and a second end for contacting a target area. Further, the platform comprises a multiple number of first actuators for moving the carrier relative to the vessel, and at least a second actuator for moving the gangway relative to the carrier. The platform also comprises a control system arranged for driving the multiple number of first actuators, and motion sensors for measuring motions relative to at least one element in a target area, which measurements are used as input for the control system. The control system is also arranged for driving the at least one second actuator.

27 Claims, 4 Drawing Sheets

(51) Int. Cl.
*B63J 99/00* (2009.01)
*B63B 17/00* (2006.01)

(58) Field of Classification Search
IPC ..... B63B 27/14,27/143, 2017/0072
See application file for complete search history.

(56) References Cited

U.S. PATENT DOCUMENTS

| | | | | |
|---|---|---|---|---|
| 4,892,051 | A | 1/1990 | Taylor et al. | |
| 6,468,082 | B1 | 10/2002 | Denne | |
| 6,659,703 | B1 | 12/2003 | Kirkley | |
| 6,955,134 | B2 | 10/2005 | Prins | |
| 7,686,543 | B2 | 3/2010 | They | |
| 8,672,288 | B2 | 3/2014 | van der Tempel et al. | |
| 8,745,801 | B2 * | 6/2014 | Prins | B63B 27/14 114/362 |
| 9,174,710 | B2 * | 11/2015 | van der Tempel | B63B 17/00 |
| 9,278,736 | B2 * | 3/2016 | Van Der Tempel | B63B 27/14 |
| 2010/0032543 | A1 | 2/2010 | Van Der Tempel et al. | |
| 2013/0198979 | A1 | 8/2013 | Dudson et al. | |
| 2015/0259047 | A1 | 9/2015 | Fleischer et al. | |
| 2015/0344110 | A1 * | 12/2015 | van der Tempel | B63B 27/14 114/230.2 |
| 2015/0375836 | A1 * | 12/2015 | van der Tempel | B63B 17/00 701/22 |

* cited by examiner

METHOD FOR CONTROLLING A VESSEL MOTION COMPENSATING PLATFORM

CROSS-REFERENCE TO RELATED APPLICATIONS

This application is a divisional of U.S. application Ser. No. 13/816,332 (published as US 2013/0212812), filed Apr. 8, 2013, which is a U.S. National Stage application under 35 U.S.C. §371 of International Application PCT/NL2011/050561 (published as WO 2012/021062 A1), filed Aug. 12, 2011, which claims priority to Application NL 2005231, filed Aug. 13, 2010. Benefit of the filing date of each of these prior applications is hereby claimed. Each of these prior applications is hereby incorporated by reference in its entirety.

FIELD OF THE INVENTION

The invention relates to a vessel including a motion compensation platform, which platform comprises at least one carrier for bearing, moving and/or transferring a load, a gangway provided with a first end pivotably connected to the carrier and a second end for contacting a target area, a multiple number of first actuators for moving the carrier relative to the vessel, at least a second actuator for moving the gangway relative to the carrier, a control system arranged for driving the multiple number of first actuators, and motion sensors for measuring motions relative to at least one element in a target area, which measurements are used as input for the control system.

BACKGROUND OF THE INVENTION

Such a vessel is e.g. known from the International patent publication WO 2007/120039. The platform comprises a carrier borne by six hydraulic cylinders, and a movable gangway connected to the carrier providing a connection between the carrier and the fixed world, such as an offshore construction. During use, with the aid of the sensors, the motions of the respective ship are measured. With the aid of these measurements, the orientation of the hydraulic cylinders is driven continuously so that the carrier remains approximately stationary relative to the fixed world. In this manner, motions of the ship are compensated so that a transfer between the ship and the fixed world, or vice versa, is made possible.

SUMMARY OF THE INVENTION

One of the objects of the invention is to improve a vessel including a motion platform.

Another object of the invention is to reduce manufacturing costs of a motion platform.

At least one of these and other objects are achieved with a vessel according to the preamble wherein the control system is also arranged for driving the at least one second actuator.

By driving also the at least one second actuator, a motion of the vessel with respect to a target area can at least partly be compensated by a movement of the gangway with respect to the carrier, thereby reducing the required compensating performance of the carrier with respect to the vessel. As an example, the control system of the platform can be arranged for compensating a motion of the vessel in at least one degree of freedom, e.g. the vertical position of the vessel, by driving the at least one second actuator. Then, the motion compensation performed by the carrier has to be executed in merely five degrees of freedom. Since the requirements for compensating performance of the carrier relax, the design of the carrier can be simpler, thus reducing the manufacturing costs.

The control system can be arranged for driving the multiple number of first actuators and the at least one second actuator for maintaining the second end of the gangway substantially stationary relative to a target area, so that and integral compensation approach is applied for compensating vessel movements, and a safe transfer between the carrier and the target area can be provided.

Preferably, the control system is arranged for compensating the motion of the vessel in less than five degrees of freedom, e.g. three degrees of freedom, by driving the multiple number of first actuators. As an example, the carrier then compensates for the roll, pitch and yaw of the vessel, so that the multiple number of first actuators can be implemented relatively compact, thus further reducing the manufacturing costs.

It is noted that in this context, the target area is to be understood as an area in a structure that is free from the vessel, having a position that is independent from the vessel position, being either stationary, such as an offshore construction, or moving in another manner than the vessel, e.g. another vessel, thereby enabling ship-to-ship passage.

The invention also relates to a motion platform.

In addition, the invention relates to a control system.

The invention further relates to a method for compensating motions of a vessel.

Moreover, the invention relates to a computer program product. A computer program product may comprise a set of computer executable instructions stored on a data carrier, such as a CD or a DVD. The set of computer executable instructions, which allow a programmable computer to carry out the method as defined above, may also be available for downloading from a remote server, for example via the Internet.

Other advantageous embodiments according to the invention are described in the following claims.

BRIEF DESCRIPTION OF THE DRAWINGS

In clarification of the invention, exemplary embodiments of a vessel, motion platform, method and use according to the invention will be further elucidated with reference to the drawing. In the drawing.

DETAILED DESCRIPTION OF THE INVENTION

Figure 1:
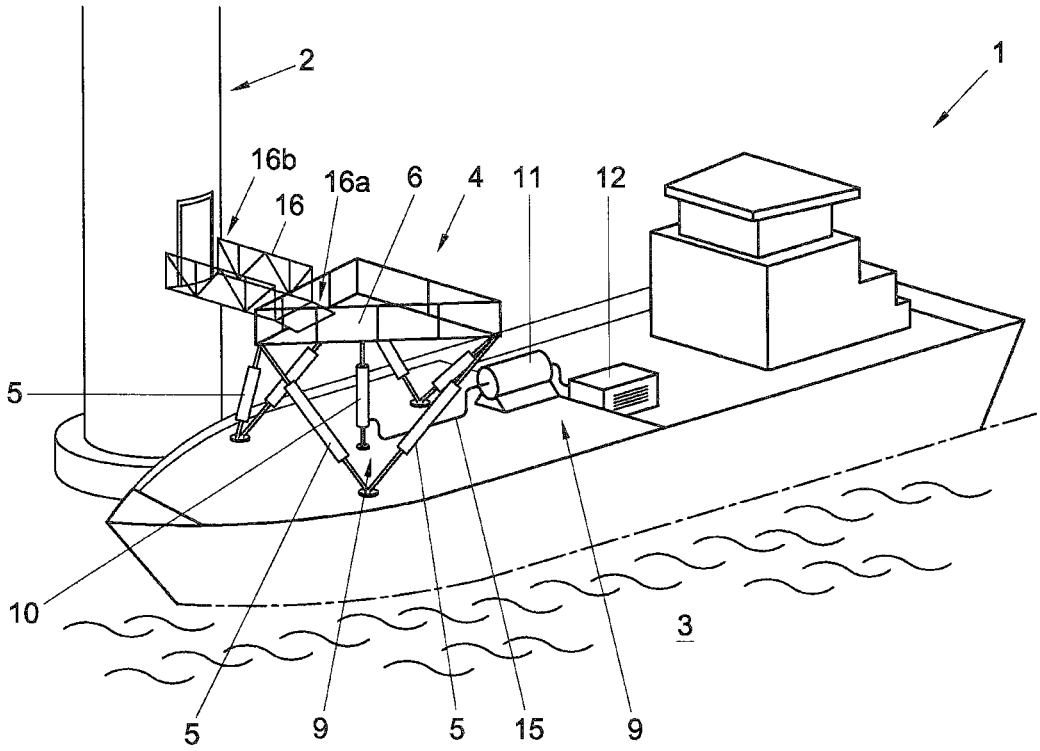
FIG. 1 shows a schematic perspective view of a vessel according to the invention.

In this description, identical or corresponding parts have identical or corresponding reference numerals. In the drawing, embodiments are given only as examples. The parts used there are mentioned merely an as example and should not be construed to be limitative in any manner. Other parts too can be utilized within the framework of the present invention.

FIG. 1 schematically shows an embodiment of a vessel 1 according to the invention. With this vessel 1, a load such as for instance people, animals, goods and/or other loads can be transferred from the vessel 1 to a target area, such as a frame or base of, for instance, a windmill 2 at sea 3, and vice versa. For transfer, the vessel 1 is provided with a motion compensation platform 4. This platform compensates for motions of the vessel 1 for the purpose of holding the part of the platform contacting the windmill 2 relatively still relative to the windmill 2, so that for instance people such as windmill construction personnel can transfer relatively safely. The motions of the vessel 1 that can be compensated may comprise linear motions such as surge (vessel moves from front to back), heave (up and down) and sway (sideways), and rotating motions such as roll (bow from left to right) yaw (the vessel 1 rolls from left to right) and pitch (bow up and down). Naturally, the motions of the vessel 1 are often combinations of these linear and rotational motions.

This transferring from or to the vessel 1 should of course not be limited to the transfer from and/or to windmills 2. In principle, transferring can be carried out between the vessel 1 and any other surrounding element 2. The vessel 1 is suited for transferring, for instance, people, animals and/or loads to, in principle, any offshore construction, such as platforms at sea 3 and/or other constructions in the water 3, etc. In certain embodiments, a vessel 1 according to the invention is designed for transferring to any part connected to the fixed world, such as a quay, a levee, cliffs, steep rocks, (sea)floor etc. In certain embodiments, a vessel 1 has been made suitable for transferring to other moving elements and/or floating elements, such as, for instance, other vessels. To that end, with the aid of, for instance, a camera, optical sensor or the like, the motions of such a moving element can be registered and be compensated by the active components of the platform.

In the embodiment shown, the motion compensation platform 4 is provided with a carrier 6 and a multiple number of first actuators, implemented as six hydraulic cylinders 5*a*, for moving the carrier. Such a motion platform 4 is known as simulation platform, as "Stewart" platform. The carrier 6 can be designed to be movable in six degrees of freedom. However, according to an aspect of the invention, the carrier can also be designed to be movable in less degrees of freedom, e.g. three degrees of freedom, e.g. with respect to roll, yaw and pitch. The platform 4 further comprises a gangway 16 having a first end 16*a* and a second end 16*b*. The gangway first end 16*a* is pivotably connected to the carrier 6. Further, the gangway second end 16*b* is in contact with the windmill 2 construction. The gangway can be moved with respect to the carrier 6 by driving at least a second actuator provided by the platform. In operation, the second end of the gangway 16*b* will be held, according to an aspect of the invention, substantially stationary relative to the windmill 2 by actively driving the multiple number of hydraulic cylinders 5*a* and the at least one second actuator. To that end, the platform is further provided with motion sensors and a control system for appropriately driving the respective actuators.

Figure 2:
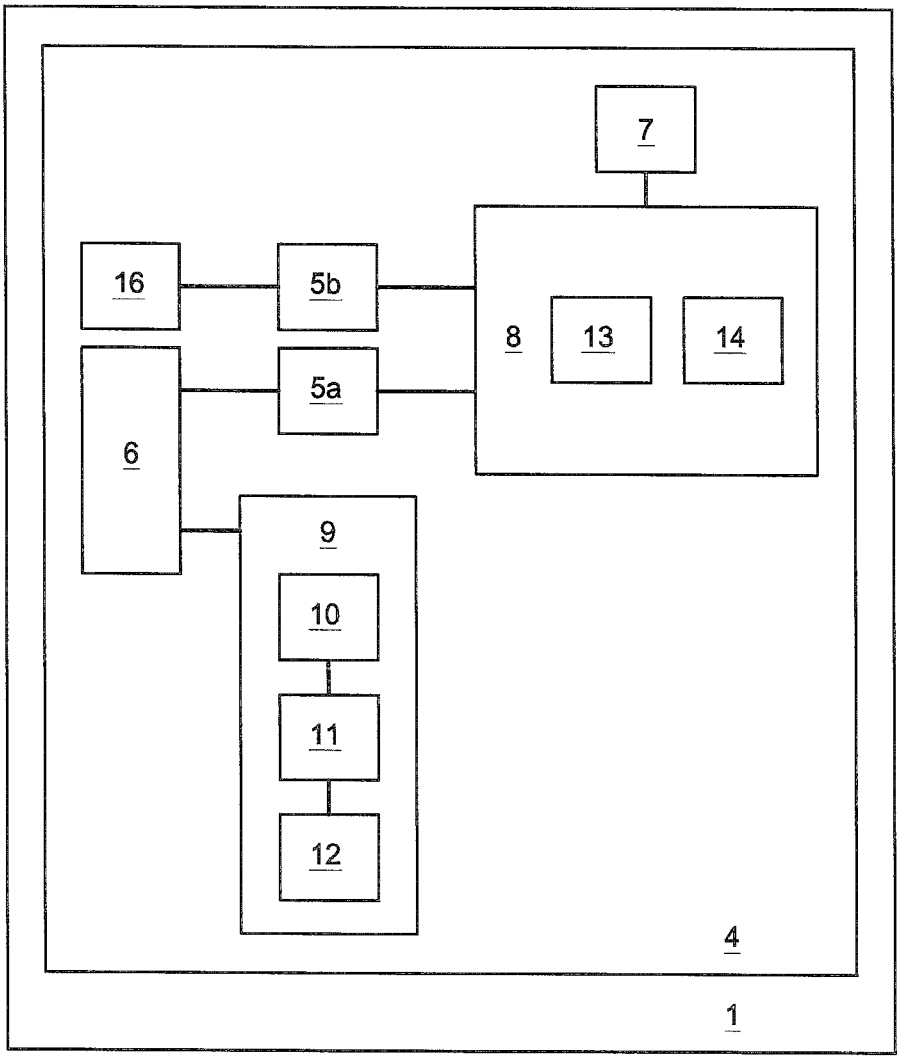
FIG. 2 shows a schematic diagram of the vessel shown in FIG. 1.

FIG. 2 shows a schematic diagram of the vessel 1. The control system 8 is connected to the motion sensors 7 for receiving motion sensor data, for instance the rocking of the vessel 1 in the water 3. With the aid of these measurement data, during use, a first driving signal and a second driving signal are generated for driving the hydraulic cylinders 5*a* and the at least one second actuator 5*b*, respectively, for moving the carrier 6 with respect to the vessel 1 and for moving the gangway 16 with respect to the carrier 6, respectively, in order to maintain the second end 16*b* of the gangway substantially stable relative to the target area. In order to generate the driving signals, the control system 8 is provided with processor 13. The control system also includes a memory 14. Processing these measurements and actively driving the hydraulic cylinders 5*a* and the at least one second actuator is a task to be performed by the control system 8.

The actuators 5*a*, 5*b* may include pneumatic and/or hydraulic means, linear motors, electric driving elements etc. In the shown embodiment, the pneumatic means 9 comprise at least one pneumatic cylinder 10 which is placed approximately in the centre of the motion compensation platform 4 and is connected via pipes 15 to a pressure compensator in the form of an accumulator 11 for buffering the compressed air, and a compressor 12 for compressing air. After filling with compressed air in the pneumatic cylinder 10 and the accumulator 11, after provision of a load, the cylinder 10 will remain pressurized and it can continue bearing at least a part of the load. The pneumatic cylinder 10 may have the property of passively moving along in its longitudinal direction. Motions of the carrier 6 in the longitudinal direction of the cylinder 10 are followed by compression and expansion of the air in the cylinder 10 and the accumulator 11. Small pressure losses in the pneumatic cylinder 10 through, for instance, friction can be measured and compensated with the aid of, for instance, the compressor 12 and/or the control system 8. Such pneumatic means 9 are known per se from the so-called 'heave compensation' systems. By placing this longitudinal direction in the direction of gravity, a great force, e.g. that of the weight of the carrier 6 and the load, will be continuously absorbed by the passive pneumatic means 9, and hence also in the case of a defect in the active elements of the motion compensation platform 4 such as, for instance, the sensors 7, the control system 8 and/or the hydraulic cylinders. In particular embodiments, the pneumatic means 9 are advantageously placed in other directions, for instance for compensating the tilting motions of the carrier 6 after, for instance, a defect. In this way, upon a defect of an element such as a cylinder 5, the pneumatic means 9 can prevent the motion compensation platform from making a relatively unsafe motion, such as, for instance, collapsing. Defects that might occur are, for instance, power supply failure or valves in the active hydraulic system becoming wedged. Naturally, also, other, preferably passive, pressure systems 9 can be utilized within the framework of the invention. In certain embodiments, instead of and/or in addition to pneumatic means 8, that is the cylinder 10, at least one spring can be utilized as passive element 10, for instance a spiral and/or gas spring. The pneumatic means 9 can, in principle, comprise different types of pressure elements such as, for instance, hydraulic means and/or elastic means and/or a pulling element, etc. Naturally, one or more pressure elements can be utilized. Depending on, for instance, the expected use, desired precision and/or economic considerations, one particular type, one particular amount and/or positioning can be selected. A passive pressure system 9 provides security in that it will, in principle, not fail and can remain functional without continuous actuation. Also, such a passive system 9 can remain of limited complexity.

Figure 3:
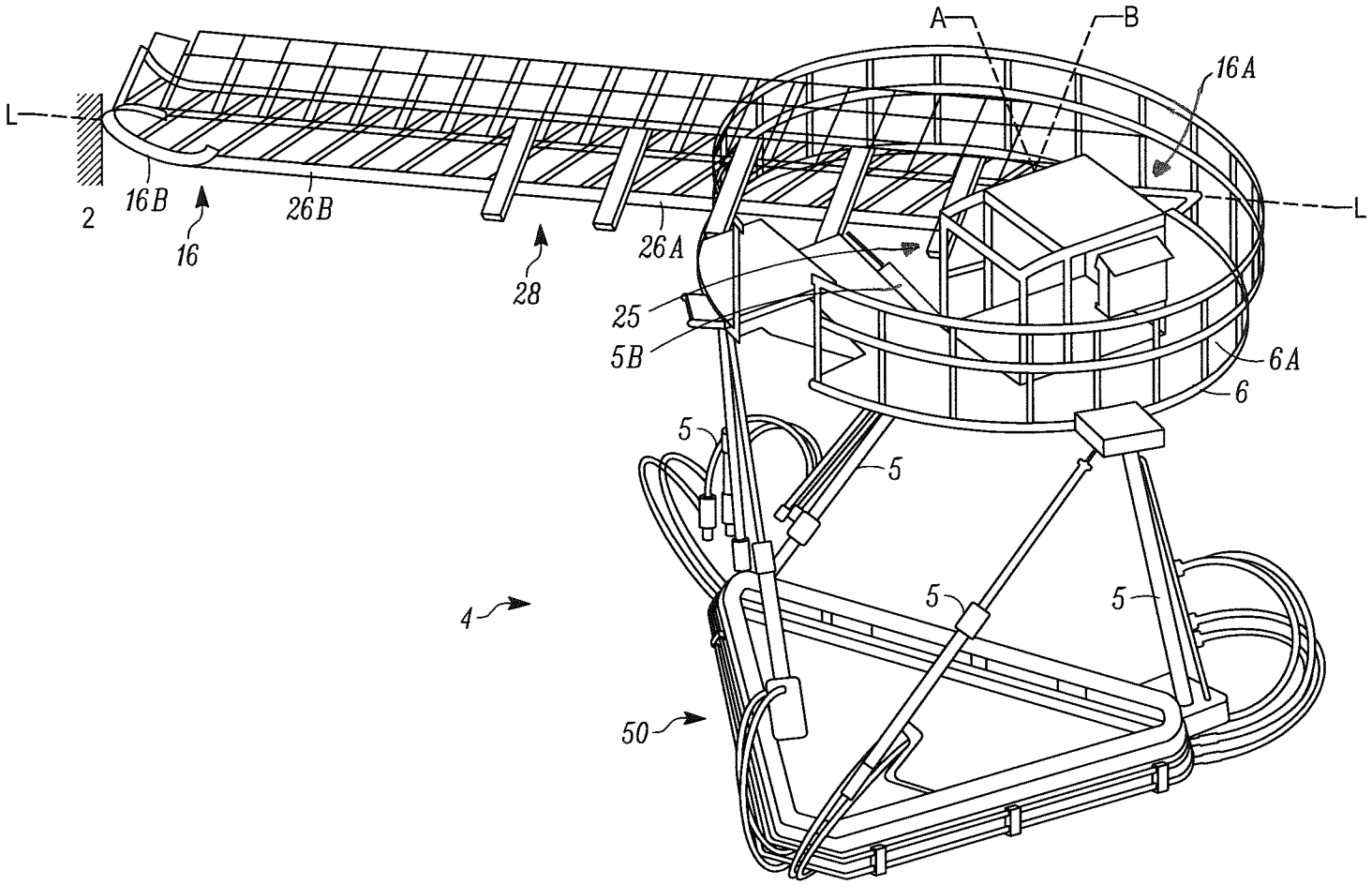
FIG. 3 shows a schematic perspective of a motion platform according to the invention.

FIG. 3 shows a schematic perspective of a motion platform 4 according to the invention. The platform includes a framework 50 rigidly fixed to the vessel 1. The multiple number of first actuators 5 bear the carrier 6 on the framework 50. The carrier 6 is provided with a top surface 6 on which the gangway 16 is pivotably mounted via a pivot mechanism 25. Further, FIG. 3 shows the second actuator 5*b* enabling the second end 16*b* of the gangway 16 to be lifted and lowered with respect to the carrier 16. More specifically, the second actuator 5*b* is arranged for pivoting the gangway 16 with respect to a first pivoting angle A substantially parallel to the carrier 6 and transverse with respect to a longitudinal axis L of the gangway 16. Thus, by pivoting the gangway 16 around the first pivoting angle A, the second end 16*b* of the gangway can be lifted or lowered to follow a target height of the target area 2.

The platform is further provided with another second actuator (not shown) that is arranged for pivoting the gangway 16 with respect to a second pivoting angle B substantially transverse with respect to the plane wherein the carrier 6 extends, so that the gangway may swivel clockwise or counter-clockwise in a substantially horizontal plane.

The gangway includes a first gangway section 26*a* and a second gangway section 26*b* mutually interconnected via a translation mechanism 28. The first gangway end 16*a* is provided on the first gangway section 26*a,* while the second gangway end 16*b* is provided on the second gangway section 26*b*. The platform is further provided with yet a further second actuator, e.g. integrated in the translation mechanism 28, for moving the second gangway section 26*b* with respect to the first gangway section 26*a* substantially along the gangway longitudinal axis L, so that the gangway second end 16*b* may follow a lateral, horizontal movement of the vessel with respect to the target area 2.

By compensating a vessel movement via actively driving all second actuators 5*b,* a motion compensation in three degrees of freedom can be performed such that the carrier 6 has to compensate for the other three degrees only.

It is noted that in another embodiment of the motion platform according to the invention, another design can be implemented, e.g. having only two second actuators or only one second actuator. Then, the carrier has to perform a motion compensation in more degrees of freedom, e.g. four degrees or five degrees of freedom.

In particular embodiments, the motion sensors 7 comprise known motion sensors 7 such as for measuring motions of the vessel 1, for instance accelerometers or dynamometers. With known accelerometers, the motion of the vessel 1 relative to the fixed world can be measured. Also, in particular embodiments, other types of sensors 7 can be utilized, such as for instance cameras, GPS (Global Positioning System), sensors utilizing electromagnetic waves, sonic waves, etc. The sensors 7 may measure the position of the vessel 1 relative to one or more elements in the surrounding area, such as for instance towards another vessel 1 and/or the fixed world. The information the control system 8 receives from the motions sensors 7 is processed via, for instance, preprogrammed algorithms so that the actuators 5*a,* 5*b* can be driven for holding the second end 16*b* of the gangway 16 approximately stationary relative to the target area 2.

Advantageously, the motion sensors include orientation sensors and sensors for measuring a relative distance towards the target area, so that another orientation and/or another position can be measured, thereby avoiding the use of absolute position sensors. As a result, the motion sensors can be implemented in a relatively cheap manner.

The measurements may further include providing measurement data performed from another structure, e.g. another vessel, concerning movements of the vessel at hand. Measurements may also include providing laser data or video data to retrieve relative position data.

In this respect it is noted that the use of orientation sensors and sensors for measuring a distance towards the target area can not only be applied with the method according to claim 14, but also, more generally, in combination with a method for compensating motions of a vessel, comprising the steps of measuring motions relative to at least one element in a target area and driving a multiple number of first actuators for moving a carrier relative to the vessel.

The measurements may include providing sensor data of motions of the vessel, the platform and/or the gangway, preferably the second end of the gangway, relative to the target area 2. In particular, vertical position data of the second end 16*b* of the gangway can be obtained by measuring the height of said gangway second end 16*b* relative to the target area 2, thereby enabling the control system 8 to follow the target area height relatively easily and accurately by driving the second actuator controlling pivoting the gangway relative to the first pivoting axis A.

The operation of an embodiment of the motion platform 4 is approximately as follows. When the vessel 1 is close to the windmill 2, the platform 4 is activated. Any vessel motions are measured via the sensors 7, which measurement data is used as input for the control system 8. In response to the measurement data, a first driving signal and a second driving signal is generated for driving the respective actuators. Through continuous adjustment of the actuators 5*a,* 5*b* the gangway second end 16*b* will be able to virtually stand still relative to the windmill 2, so that personnel and/or the load can be transferred safely.

Figure 4:
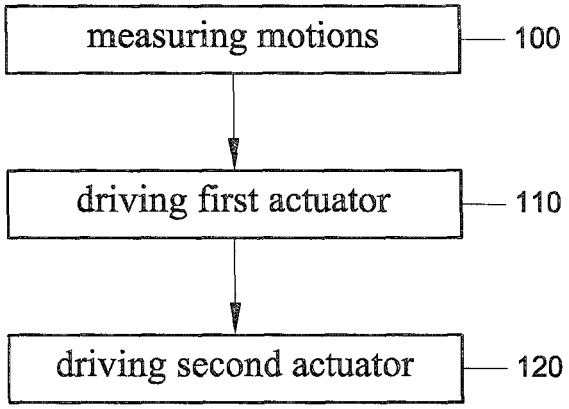
FIG. 4 shows a flow chart of an embodiment of a method according to the invention.

FIG. 4 shows a flow chart of an embodiment of the method according to the invention. The method can be used for compensating motions of a vessel. The method comprises a step of measuring motions relative to at least one element in a target area 100, a step of driving a multiple number of first actuators for moving a carrier relative to the vessel 110, and a step of driving at least one second actuator for moving a gangway that is pivotably connected to the carrier 120.

The method for compensating motions of a vessel can at least partly be performed using dedicated hardware structures, such as FPGA and/or ASIC components. Otherwise, the method can also at least partially be performed using a computer program product comprising instructions for causing a processor of the computer system to perform the above described steps of the method according to the invention. Processing steps can in principle be performed on a single processor, in particular steps of providing first and second driving signals for driving the multiple number of first actuators and the at least one second actuator. However, it is noted that at least one step can be performed on a separate processor, e.g. a step of receiving motion sensor data of motions relative to at least one element in a target area.

These and may comparable variations, as well as combinations thereof, are understood to fall within the framework of the invention as outlined by the claims. Naturally, different aspects of the different embodiments and/or combinations thereof can be combined with each other and be exchanged within the framework of the invention. Therefore, the embodiments mentioned should not be understood to be limitative.

What is claimed is:

1. A method for controlling a motion compensation platform of a vessel, the motion compensation platform comprising a carrier and a gangway having a proximal first end and a distal second end for approaching a target area, the method comprising:

(a) measuring motion relative to an element in the target area;

(b) moving the carrier relative to the vessel to partly compensate for the relative motion measured in step (a); and (c) moving the gangway relative to the carrier to partly compensate for the relative motion measured in step (a), wherein steps (b) and (c), in combination, reduce actual motion between the second end of the gangway and the target area.

2. The method of claim 1, wherein step (a) is performed using orientation sensors that determine a relative orientation with respect to the target area.

3. The method of claim 1, wherein the target area is affixed to land or the sea floor.

4. The method of claim 1, wherein the target area is floating.

5. The method of claim 1, wherein the actual motion reduced by steps (b) and (c) in combination is selected from the group consisting of a front-to-back motion, an up-and-down motion, a sideways motion, a roll rotating motion, a yaw rotation motion, a pitch rotating motion, and combinations thereof.

6. The method of claim 1, wherein step (b) is performed using a plurality of first actuators.

7. The method of claim 6, wherein step (c) is performed using at least one second actuator.

8. A method according to claim 7, wherein the motion compensation platform is a Stewart platform.

9. The method of claim 7, wherein the plurality of first actuators and the at least one second actuator are selected from the group consisting of hydraulic actuators, pneumatic actuators, electric actuators, and combinations thereof.

10. The method of claim 9, wherein the plurality of first actuators and the at least one second actuator are hydraulic actuators.

11. The method of claim 7, wherein, in step (c), the moving of the gangway with respect to the carrier reduces a compensating requirement of the plurality of first actuators for moving the carrier relative to the vessel in step (b), compared to compensating for motions of the vessel in the absence of the at least one second actuator.

12. The method of claim 7, wherein, in step (c), the moving of the gangway with respect to the carrier compensates for the motion measured in step (a), in at least one degree of freedom.

13. The method of claim 12, wherein the plurality of first actuators move the carrier relative to the vessel to compensate for the relative motion in step (b), in fewer than six degrees of freedom.

14. The method of claim 13, wherein the plurality of first actuators move the carrier relative to the vessel to compensate for a roll rotating motion, a yaw rotating motion, and a pitch rotating motion in step (b).

15. The method of claim 12, wherein, in step (c), the moving of the gangway with respect to the carrier compensates for the motion measured in step (a), in at least two degrees of freedom.

16. The method of claim 15, wherein step (c) is performed using at least two second actuators, including an additional second actuator configured to swivel the gangway clockwise or counter-clockwise.

17. The method of claim 15, wherein step (c) is performed using at least two second actuators, including a further second actuator configured to move the second end of the carrier longitudinally relative to the first end, using a translation mechanism.

18. The method of claim 1, wherein steps (b) and (c), in combination, substantially eliminate the actual motion between the second end of the gangway and the target area.

19. The method of claim 1, wherein the first end of the gangway is pivotably connected to the carrier.

20. The method of claim 1, wherein the measuring step a) includes measuring relative motion between the vessel and an element in the target area.

21. The method of claim 1, wherein the steps of moving the carrier and the gangway are performed in response to the motion measurements.

22. The method of claim 1, wherein the measuring step (a) includes measuring motions of the vessel, the platform, the carrier and/or the gangway, relative to the at least one element in the target area.

23. The method of claim 1, wherein the movement of the gangway with respect to the carrier maintains the second end of the gangway substantially stationary relative to the target area during transfer of a load from the vessel to the target area.

24. The method of claim 22, where the measuring step (a) includes measuring motions of the second end of the gangway, relative to the at least one element in the target area.

25. A control system for controlling a motion compensation platform according to the method of claim 1, the control system having a processor configured for:

receiving sensor data representing motion relative to an element in the target area, and transmitting a first drive signal for moving the carrier;

transmitting a second drive signal for moving the gangway relative to the carrier and that partly compensates for the motion relative to the element in the target area, using the sensor data as input.

26. A non-transitory computer readable medium having a computer program embodied thereon, the computer program for controlling a motion compensation platform according to the method of claim 1 and including instructions for causing a processor to perform the steps of:

receiving sensor data representing the motion relative to an element in the target area, and transmitting a first drive signal for moving the carrier;

transmitting a second drive signal for moving the gangway relative to the carrier and that partly compensates for the motion relative to the element in the target area, using the sensor data as input.

27. A method for controlling a motion compensation platform of a vessel, the motion compensation platform comprising a carrier and a gangway, the method comprising:

(a) measuring motion relative to an element in a target area;

(b) moving the carrier relative to the vessel; and (c) moving the gangway relative to the carrier to at least partly compensate for the relative motion measured in step (a).

* * * * *